US012702227B2

(12) United States Patent
Martin

(10) Patent No.: US 12,702,227 B2
(45) Date of Patent: Aug. 11, 2026

(54) SHELVING BRACKET AND SYSTEM

(71) Applicant: Yosemite Shelving LLC, Oakhurst, CA (US)

(72) Inventor: Stan Martin, Visalia, CA (US)

(73) Assignee: Yosemite Shelving LLC, Oakhurst, CA (US)

( * ) Notice: Subject to any disclaimer, the term of this patent is extended or adjusted under 35 U.S.C. 154(b) by 76 days.

(21) Appl. No.: 18/648,111

(22) Filed: Apr. 26, 2024

(65) Prior Publication Data

US 2024/0358151 A1 Oct. 31, 2024

Related U.S. Application Data

(60) Provisional application No. 63/462,639, filed on Apr. 28, 2023.

(51) Int. Cl.

| | |
|---|---|
| ***A47B 96/00*** | (2006.01) |
| ***A47B 57/54*** | (2006.01) |
| ***A47B 96/07*** | (2006.01) |

(52) U.S. Cl.

CPC ..... *A47B 57/54* (2013.01); *A47B 96/07* (2013.01); *A47B 2220/0036* (2013.01)

(58) Field of Classification Search

None

See application file for complete search history.

(56) References Cited

U.S. PATENT DOCUMENTS

| | | | | | |
|---|---|---|---|---|---|
| 4,230,052 | A * | 10/1980 | Champagne | F16B 12/02 | 108/147.14 |
| 4,811,670 | A * | 3/1989 | Kolvites | A47B 57/265 | 211/187 |
| 5,183,232 | A * | 2/1993 | Gale | F16B 12/44 | 52/657 |
| 5,271,337 | A * | 12/1993 | Kolvites | A47B 57/265 | 108/107 |
| 5,279,231 | A * | 1/1994 | Kolvites | A47B 57/265 | 108/107 |
| 6,390,719 | B1 * | 5/2002 | Chan | E04B 1/5806 | 52/646 |
| 6,516,732 | B1 * | 2/2003 | LaCombe | A47B 45/00 | 108/153.1 |
| 10,954,663 | B2 * | 3/2021 | Mou | E04B 1/2604 | |
| 11,236,501 | B2 * | 2/2022 | Boyd | E04B 1/1912 | |
| 2007/0209314 | A1 * | 9/2007 | Vaughn | E04B 1/24 | 52/838 |

* cited by examiner

*Primary Examiner* — Steven M Marsh
(74) *Attorney, Agent, or Firm* — Kali Law Group, P.C.

(57) ABSTRACT

Shelving brackets are presented including: a clamping channel for capturing a vertical member, where the clamping channel is vertically adjustable along the vertical member; a load distribution wall positioned along the clamping channel; a first cradle positioned along the clamping channel for capturing a first horizontal member; and a second cradle positioned along the clamping channel for capturing a second horizontal member, where the first horizontal member is retained perpendicular to the second horizontal member. In some embodiments, the clamping channel includes: a base having a frontside surface and a backside surface; a pair of clamping legs positioned along either side of the base extending from the backside surface, where the clamping legs provide a clamping action against the vertical member such that a temporary holding position is maintained.

15 Claims, 9 Drawing Sheets

SHELVING BRACKET AND SYSTEM

BACKGROUND

Storage systems are well-known in the art. Conventional storage systems appear in a dizzying array of configurations in commercial and residential applications. Often, commercial applications are customized for a particular industry while residential applications utilize more generic solutions such as uniform shelving systems available at local hardware stores. In those systems, a limited amount of customization is generally available. However, because residential applications more often utilize unique spaces, a more highly configurable system may be desirable. For example, a residential garage may be utilized as a parking space, as a storage space, as a workspace, or as a recreation space. Complicating the problem is that residential garages are not generally uniform in size, shape, and layout. Thus, the spacing requirements can vary widely from residence to residence as well as change over time as families grow and change. In these examples, conventional shelving systems may not provide an optimal solution for such changing spaces.

As such, shelving brackets and systems are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, shelving brackets are presented including: a clamping channel for capturing a vertical member, where the clamping channel is vertically adjustable along the vertical member; a load distribution wall positioned along the clamping channel; a first cradle positioned along the clamping channel for capturing a first horizontal member; and a second cradle positioned along the clamping channel for capturing a second horizontal member, where the first horizontal member is retained perpendicular to the second horizontal member. In some embodiments, the clamping channel includes: a base having a frontside surface and a backside surface; a pair of clamping legs positioned along either side of the base extending from the backside surface, where the clamping legs provide a clamping action against the vertical member such that a temporary holding position is maintained. In some embodiments, the pair of clamping legs are curved inwardly to clamping surfaces. In some embodiments, the clamping surfaces are spaced approximately 5% less than a width of the vertical member. In some embodiments, the load wall includes: a top edge, where the top edge includes a cutaway portion for receiving a recessed shelf. In some embodiments, the first cradle includes: a first cradle base for supporting the first horizontal member, the first cradle base coupled with a first bottom portion of the clamping channel and a first bottom portion of the load wall; a first outside wall extending upward from the first cradle base and coupled with the clamping channel; a first edge wall defined by a portion of the frontside surface of the clamping channel and extending upward from the first cradle base; and a first inside wall defined by a portion of the load wall proximate with the cutaway portion and extending upward from the first cradle base. In some embodiments, the second cradle includes: a second cradle base for supporting the second horizontal member, the second cradle base coupled with a second bottom portion of the clamping channel and a second bottom portion of the load wall; a second outside wall defined by a portion of the frontside surface of the clamping channel and extending upward from the second cradle base; a second edge wall defined by a portion of the load wall proximate with the cutaway portion and extending upward from the second cradle base; and a second inside wall extending upward from the second cradle base and coupled along a portion of the load wall proximate with the cutaway portion.

In other embodiments, shelving systems are presented including: a number of shelving brackets each including: a clamping channel for capturing a vertical member, where the clamping channel is vertically adjustable along the vertical member; a load distribution wall positioned along the clamping channel; a first cradle positioned along the clamping channel for capturing a first horizontal member; and a second cradle positioned along the clamping channel for capturing a second horizontal member, where the first horizontal member is retained perpendicular to the second horizontal member, where the number of shelving brackets are paired as mirror structures of one another; a number of shelf retaining clips for retaining a shelf where the number of shelf retaining clips are paired as mirror structures of one another; and a number of shelf supports for supporting the shelf. In some embodiments, the shelf retaining clips each include: a planar body; a first leg extending perpendicularly from the planar body along a first end of the planar body; a first shelf retaining clip tab extending perpendicularly from the first leg; a second leg extending perpendicularly from the planar body along a second end of the planar body; a second shelf retaining clip tab extending perpendicularly from the second leg. In some embodiments, the shelf supports each include: a planar base; an outside leg that extends downward from an outside edge of the planar base; an inside leg that extends downward from an inside edge of the planar base; and a support tab that extends perpendicular from the inside leg.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1A:
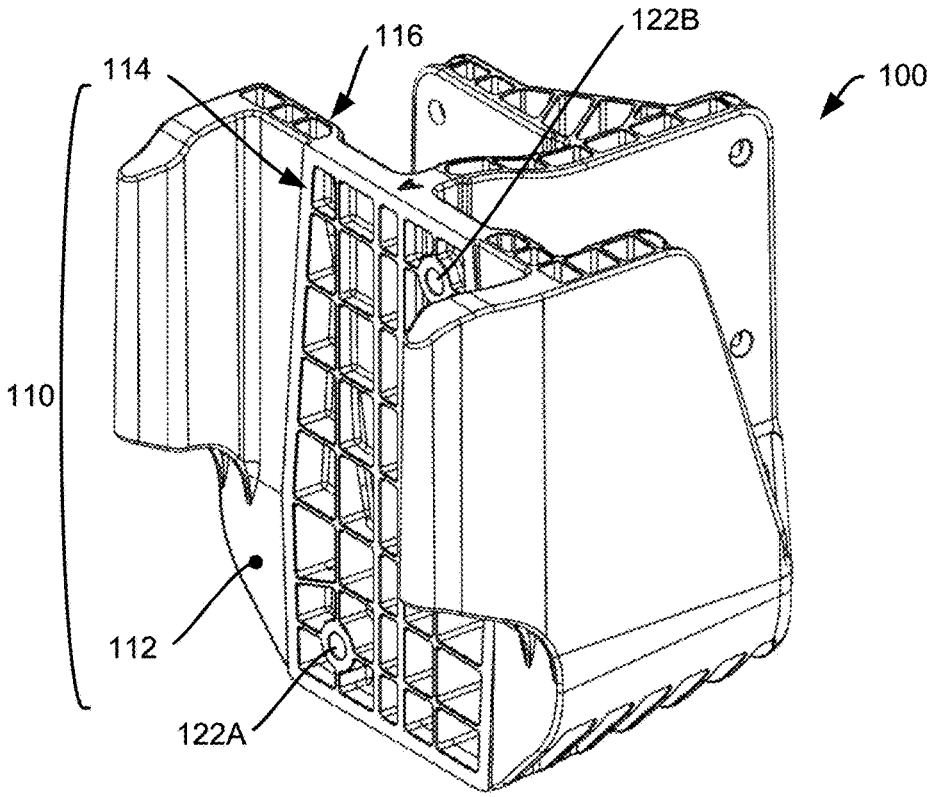
FIGS. 1A-1B are illustrative orthogonal representations of a shelving bracket in accordance with embodiments of the present invention.
Figure 1B:
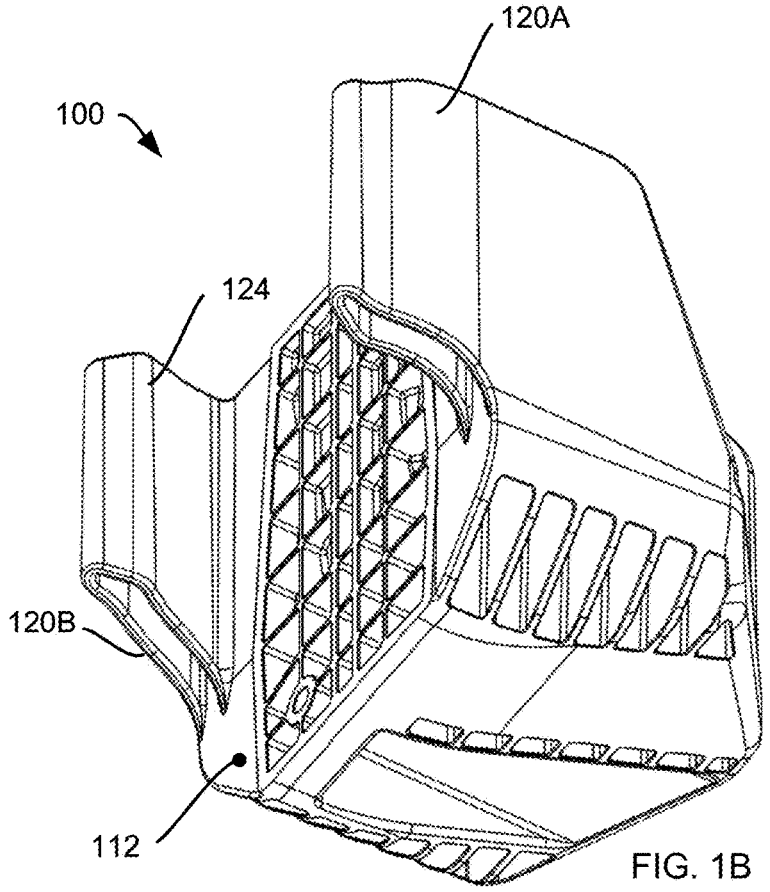

FIGS. 1A-1B are illustrative orthogonal representations of shelving bracket 100 in accordance with embodiments of the present invention. In particular, FIGS. 1A-1B illustrate different views of clamping channel 110 for clarity in understanding the embodiments disclosed herein. In embodiments, the clamping channel captures a vertical member. As utilized herein, a vertical member may include dimensional lumber in some embodiments. As is well-known in the art, common dimensional lumber refers to the standard pre-dimensioned wood used in wood-frame construction, including walls, floors, and roofs. Typically, "2×" dimensional lumber is approximately 1.50 inches thick and of various lengths and widths. Common dimensional lumber is the structural softwood lumber used in most wood-based housing construction (platform-frame construction) in North America. An advantage achieved by embodiments provided herein is that shelving brackets may be used in conjunction with readily available standardized lumber. A 2×4, for example, is a standard stud size that may be found across the country. Thus, shelving bracket embodiments may be utilized with a variety of dimensional lumber including: 2×2, 2×4, 2×6, 2×8, 2×10, 2×12 and the like for vertical members. In addition, 4×4 and 4×6 may be utilized for vertical members in some embodiments. In still other embodiments, any lumber milled to dimensional lumber sizes may be utilized without limitation. As illustrated, clamping channel 110 includes base 112 having backside surface 114 and frontside surface 116. Further illustrated are clamping legs 120A and 120B positioned along either side of base 112 and extending from backside surface 114. In operation, the clamping legs provide a clamping action against a vertical member. As illustrated, the clamping legs are curved inwardly to clamping surface 124 to provide the clamping action. In embodiments, the clamping surfaces are spaced approximately 5% less than the width of the vertical member. Thus, for example, a typical 2×4 dimensional stud measures approximately 1.50×3.50 inches. As such, along the 3.50-inch width, clamping surfaces may be spaced at 3.50 inches less 5% or approximately 3.33 inches. The clamping action allows the shelving bracket to be located along the vertical member and temporarily held there until the shelving bracket is affixed to the vertical member using holes 122A and 122B. In some embodiments, holes 122A and 122B are offset along the load wall to avoid interference. Load wall embodiments will be discussed in further detail below for FIG. 2. In embodiments, shelving brackets may be affixed to vertical members using any variety of suitable fasteners known in the art without limitation. Shelving bracket embodiments may be manufactured from a variety of materials including thermoplastic materials, polymeric materials, organic materials, metallic materials, and semi metallic materials without limitation. In addition, shelving bracket embodiments may be manufactured utilizing a variety of manufacturing processes including: milling processes, injection molding processes, and 3D printing processes without limitation.

Figure 2:
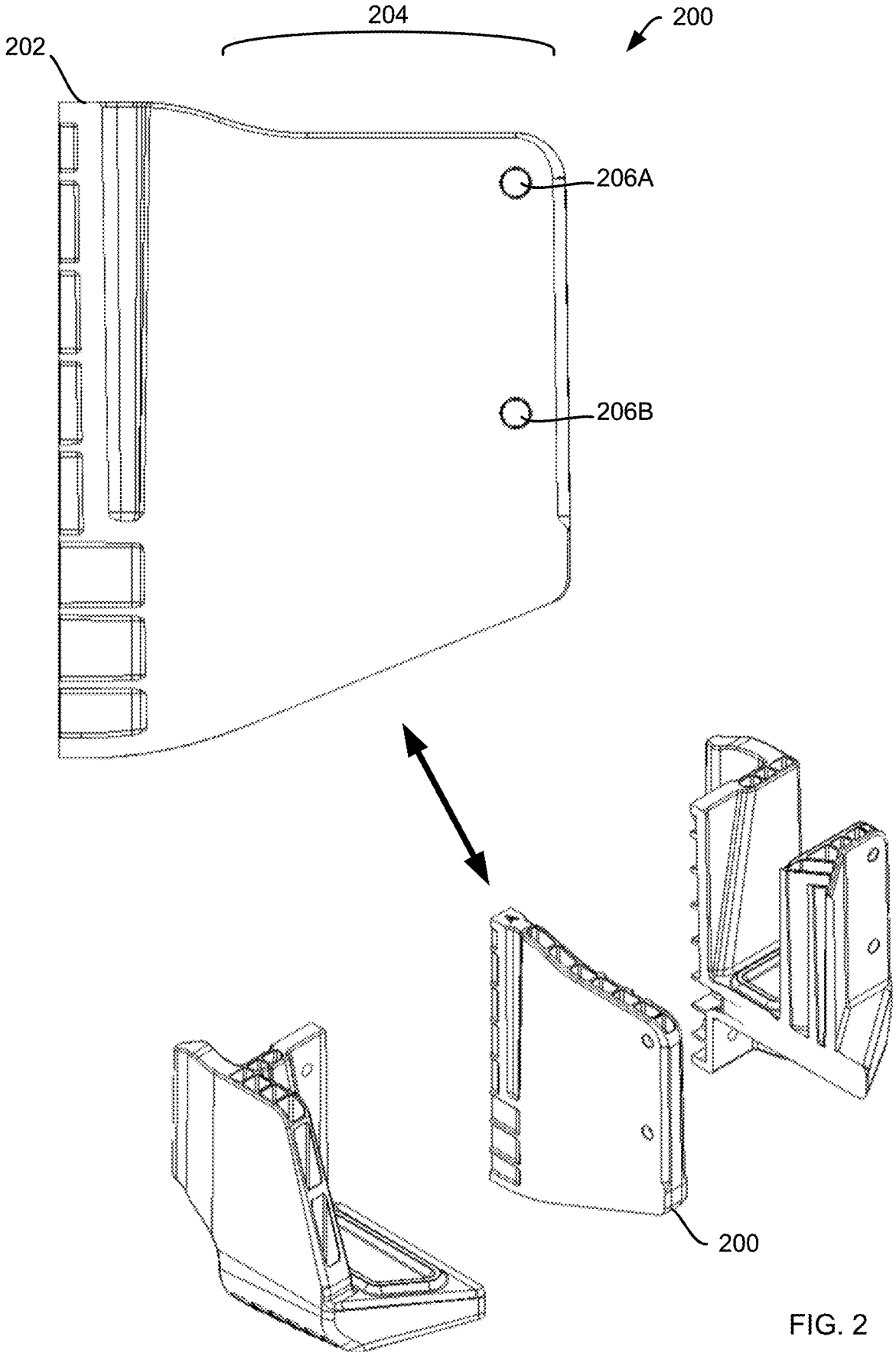
FIG. 2 is an illustrative representation of a load wall in accordance with embodiments of the present invention.

FIG. 2 is an illustrative representation of load wall 200 in accordance with embodiments of the present invention. In particular, FIG. 2 illustrates side view representation of load wall 200 as well as in an exploded representation to illustrate the position of the load wall with respect to the bracket. The exploded view does not imply or otherwise suggest that the load wall is a separately manufactured component of shelving bracket embodiments. Rather, the exploded view is provided for clarity in understanding the embodiments disclosed herein. As contemplated herein and without being bound by theory, load wall embodiments serve to transfer loads from shelves to the vertical members of the system. As such, in embodiments, the load wall is positioned along the clamping channel—the two elements providing a "backbone" for the shelving bracket to support the combined weight of the horizontal members, shelves, and items placed on the shelves. As illustrated, load wall includes top edge 202 that includes cutaway portion 204. In embodiments, cutaway portions provide a support platform for receiving a recessed shelf. Recessed shelf embodiments will be discussed in further detail below for FIG. 8. Further illustrated are holes 206A and 206B for affixing a horizontal member. Horizontal member embodiments will be discussed in further detail below for FIGS. 3A-3B and 4A-4B. As above, horizontal members may be affixed to shelving brackets using any variety of suitable fasteners known in the art without limitation.

Figure 3A:
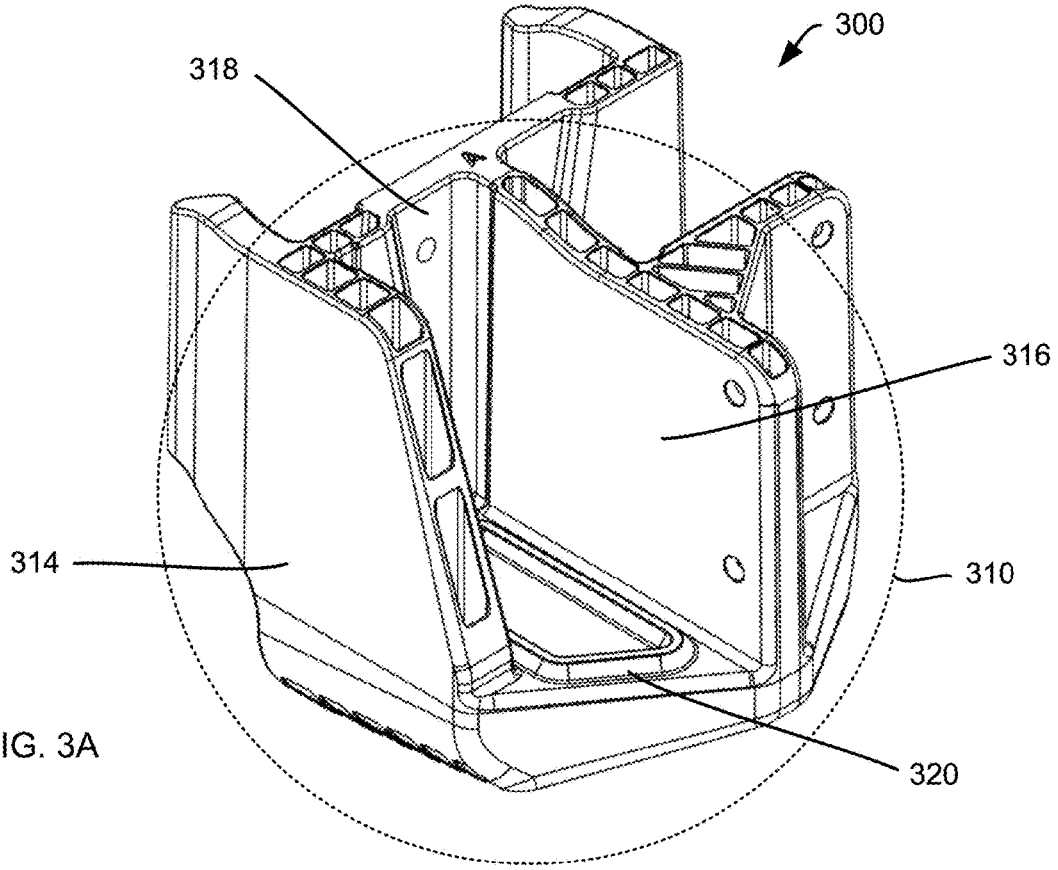
FIGS. 3A-3B are illustrative orthogonal representations of a shelving bracket in accordance with embodiments of the present invention.
Figure 3B:
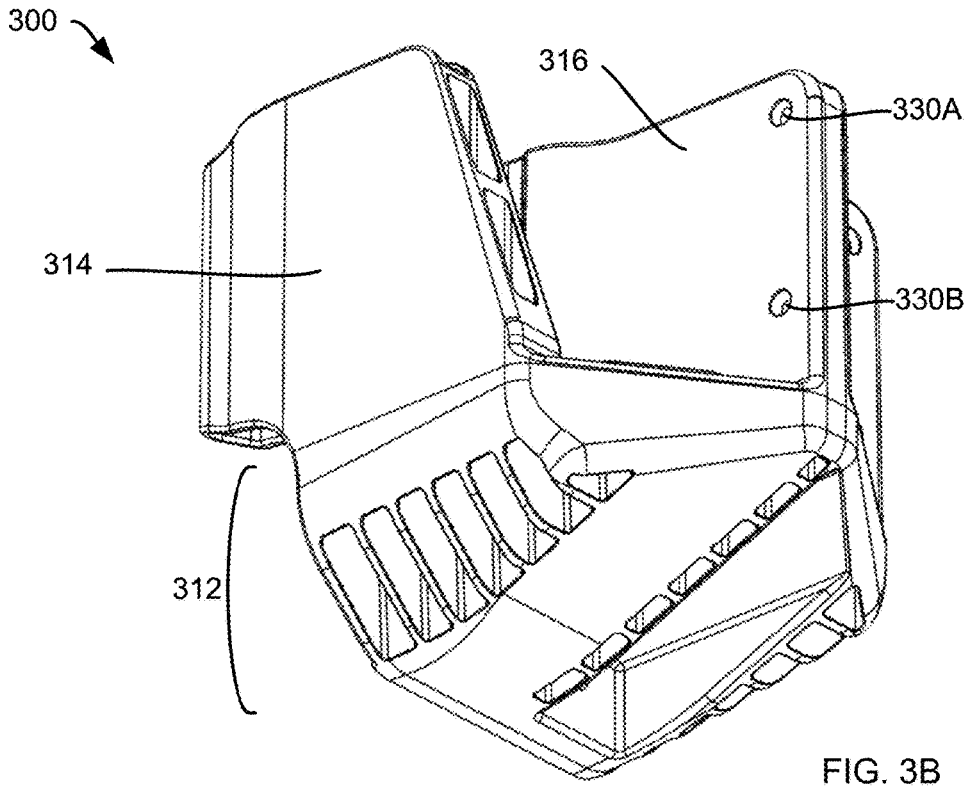

FIGS. 3A-3B are illustrative orthogonal representations of shelving bracket 300 in accordance with embodiments of the present invention. In particular, FIGS. 3A-3B illustrate different perspective views of cradle 310 for clarity in understanding the embodiments disclosed herein. In operation, cradle 310 is positioned along the clamping channel and secures a horizontal member. As utilized herein, a horizontal member may include dimensional lumber in some embodiments. As is well-known in the art, common dimensional lumber refers to the standard pre-dimensioned wood used in wood-frame construction, including walls, floors, and roofs. Typically, "2×" dimensional lumber is approximately 1.50 inches thick and of various lengths and widths. Common dimensional lumber is the structural softwood lumber used in most wood-based housing construction (platform-frame construction) in North America. An advantage achieved by embodiments provided herein is that shelving brackets may be used in conjunction with readily available standardized lumber. A 2×4, for example, is a standard stud size that may be found across the country. Thus, shelving bracket embodiments may be utilized with a variety of dimensional lumber including: 2×2, 2×4, 2×6, 2×8, 2×10, 2×12 and the like for horizontal members. In still other embodiments, any lumber milled to dimensional lumber sizes may be utilized without limitation. As illustrated, cradle 310 includes cradle base 312 that is coupled with a bottom portion of the clamping channel and a bottom portion of the load wall. Extending upward from cradle base 312 is outside wall 314 that is coupled along the clamping channel. Further extending upward from cradle base 312 is edge wall 318 that is defined by a portion of the frontside surface of the clamping channel. Cradle 310 further includes inside wall 316 that is defined by a portion of the load wall proximate with the cutaway portion (see FIG. 2, 204) and further extends upward from cradle base 312. When a horizontal member is placed in the cradle, the horizontal member rests on raised feature 320 positioned along a surface of the cradle base thereby providing relief clearance for the horizontal member. Additional relief clearances are formed along the inside corners of the cradle formed by the outside wall, the edge wall, and the inside wall in embodiments as illustrated. Further illustrated are holes 330A and 330B for affixing a horizontal member. As above, horizontal members may be affixed to shelving brackets using any variety of suitable fasteners known in the art without limitation.

Figure 4A:
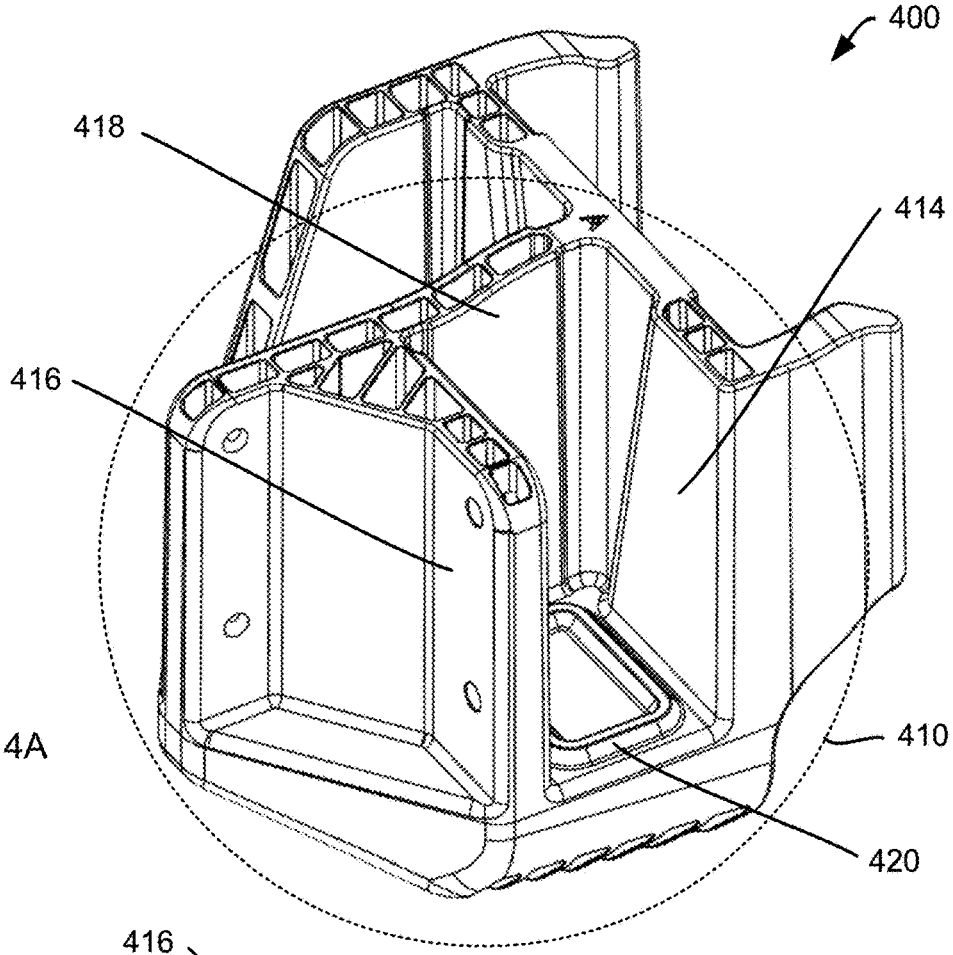
FIGS. 4A-4B are illustrative orthogonal representations of a shelving bracket in accordance with embodiments of the present invention.
Figure 4B:
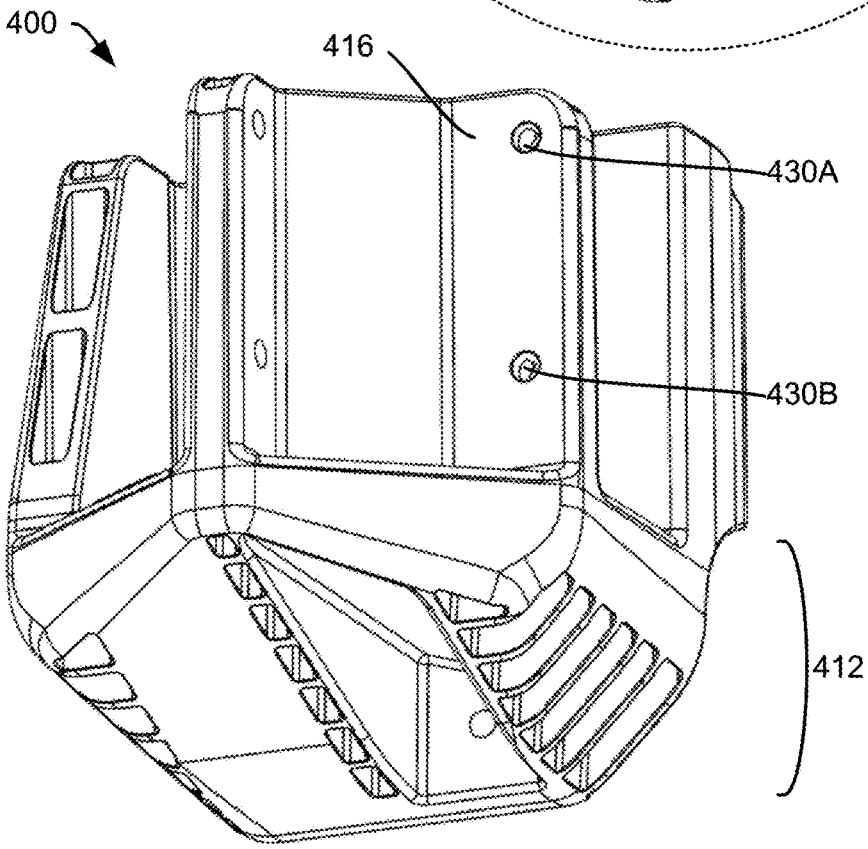

FIGS. 4A-4B are illustrative orthogonal representations of shelving bracket 400 in accordance with embodiments of the present invention. In particular, FIGS. 4A-4B illustrate different perspective views of cradle 410 for clarity in understanding the embodiments disclosed herein. In operation, cradle 410 is positioned along the clamping channel and secures a horizontal member. As utilized herein, a horizontal member may include dimensional lumber in some embodiments. As is well-known in the art, common dimensional lumber refers to the standard pre-dimensioned wood used in wood-frame construction, including walls, floors, and roofs. Typically, "2×" dimensional lumber is approximately 1.50 inches thick and of various lengths and widths. Common dimensional lumber is the structural softwood lumber used in most wood-based housing construction (platform-frame construction) in North America. An advantage achieved by embodiments provided herein is that shelving brackets may be used in conjunction with readily available standardized lumber. A 2×4, for example, is a standard stud size that may be found across the country. Thus, shelving bracket embodiments may be utilized with a variety of dimensional lumber including: 2×2, 2×4, 2×6, 2×8, 2×10, 2×12 and the like for horizontal members. In still other embodiments, any lumber milled to dimensional lumber sizes may be utilized without limitation. As illustrated, cradle 410 includes cradle base 412 that is coupled with a bottom portion of the clamping channel and a bottom portion of the load wall. Extending upward from cradle base 412 is outside wall 414 that is defined by a portion of the frontside surface of the clamping channel. Further extending upward from cradle base 412 is edge wall 418 that is defined by a portion of the load wall proximate with the cutaway portion (see FIG. 2, 204). Cradle 410 further includes inside wall 416 that extends upward from cradle base 412 and is coupled along a portion of the load wall proximate with the cutaway portion (see FIG. 2, 204). When a horizontal member is placed in the cradle, the horizontal member rests on raised feature 420 positioned along a surface of the cradle base thereby providing relief clearance for the horizontal member. Additional relief clearances are formed along the inside corners of the cradle formed by the outside wall, the edge wall, and the inside wall in embodiments as illustrated. Further illustrated are holes 430A and 430B for affixing a horizontal member. As above, horizontal members may be affixed to shelving brackets using any variety of suitable fasteners known in the art without limitation.

Shelving Bracket Systems

Figure 5:
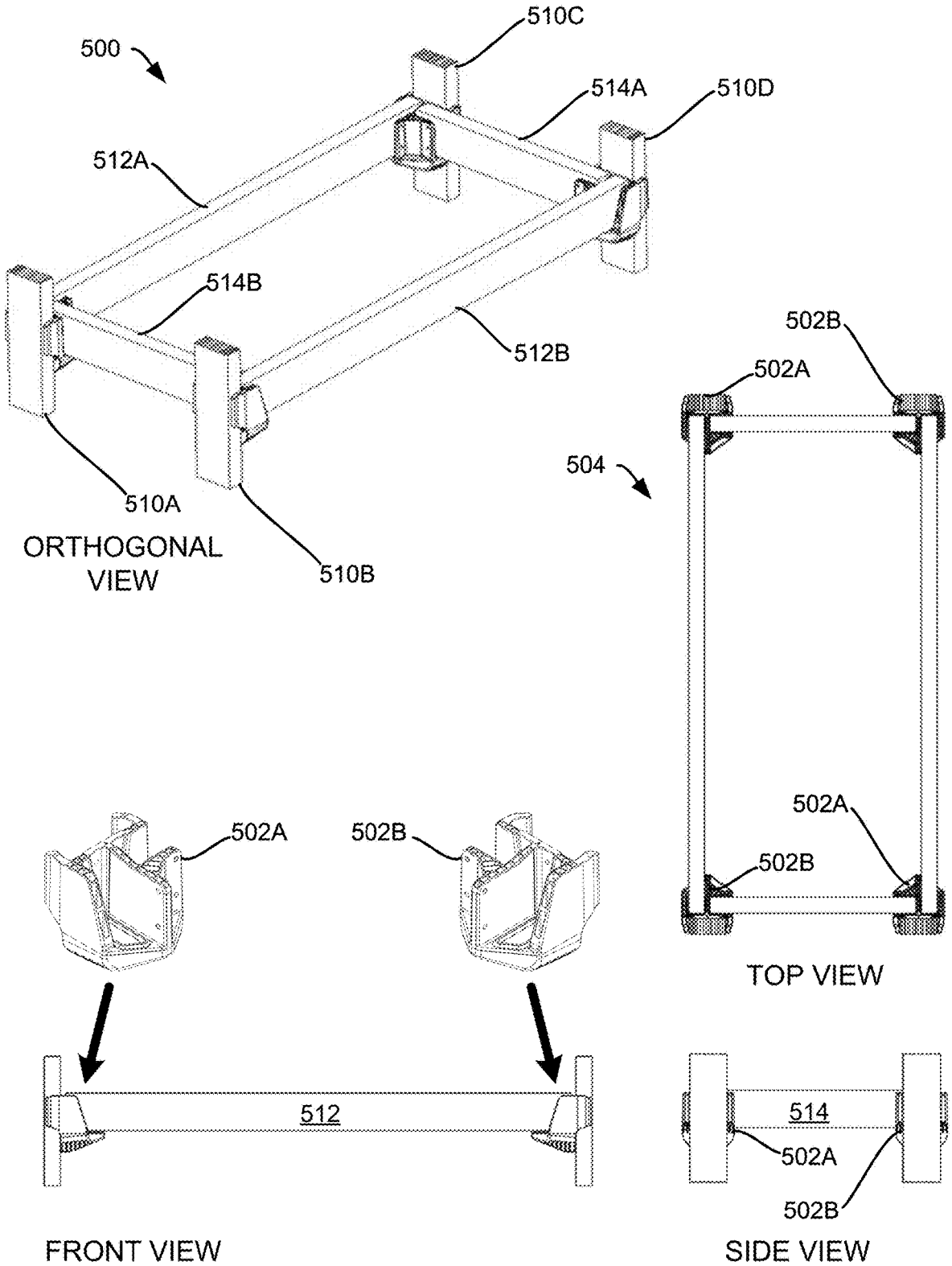
FIG. 5 is an illustrative representation of a shelving bracket system in use in accordance with embodiments of the present invention.

FIG. 5 is an illustrative representation of a shelving bracket system 500 in use in accordance with embodiments of the present invention. In particular, FIG. 5 illustrates various views of a single level embodiment. As may be appreciated, any number of levels may be achieved using embodiments provided herein. In some embodiments, a level may support a shelf, grate, or tabletop. In other embodiments, a level may serve as an additional support structure having no shelf, grate, or tabletop. As illustrated, one of shelving brackets 502A and 502B are located in each of four corners. Importantly, 502B is a reverse duplicate of 502A. That is, the structures are the same but appear as mirror images (or structures) of one another. As illustrated, shelving brackets 502A and 502B are placed in opposite corners of the system. Vertical members 510A, 510B, 510C, and 510D form the legs of the system. The vertical members may be the same length or differing lengths depending on the surface upon which the system is intended. Furthermore, because each bracket independently engages a vertical member, leveling horizontal members can easily be achieved by independently adjusting each bracket.

As illustrated, horizontal members 512A and 512B define one horizontal dimension, and horizontal members 514A and 514B define a second horizontal dimension. The illustrated embodiment shows different horizontal dimensions. However, horizontal dimensions may be the same in some embodiments. Assembly may occur in any order that is convenient for the user. In one method, shelving brackets are first placed along vertical members. The clamping channel provides a temporary clamping action before the placement is committed with fasteners. Horizontal members may then be placed in the corresponding cradles whereupon the vertical position may be evaluated. Horizontal members are held perpendicular to one another along a horizontal plane and perpendicular to the vertical member along vertical planes. Fastening holes are placed to allow fastener installation and removal from the horizontal members without interference from the rest of the system by power and hand tools. In addition, the horizontal members are fastened along the inside walls thereby hiding the fasteners to provide a more pleasing aesthetic.

Figure 6:
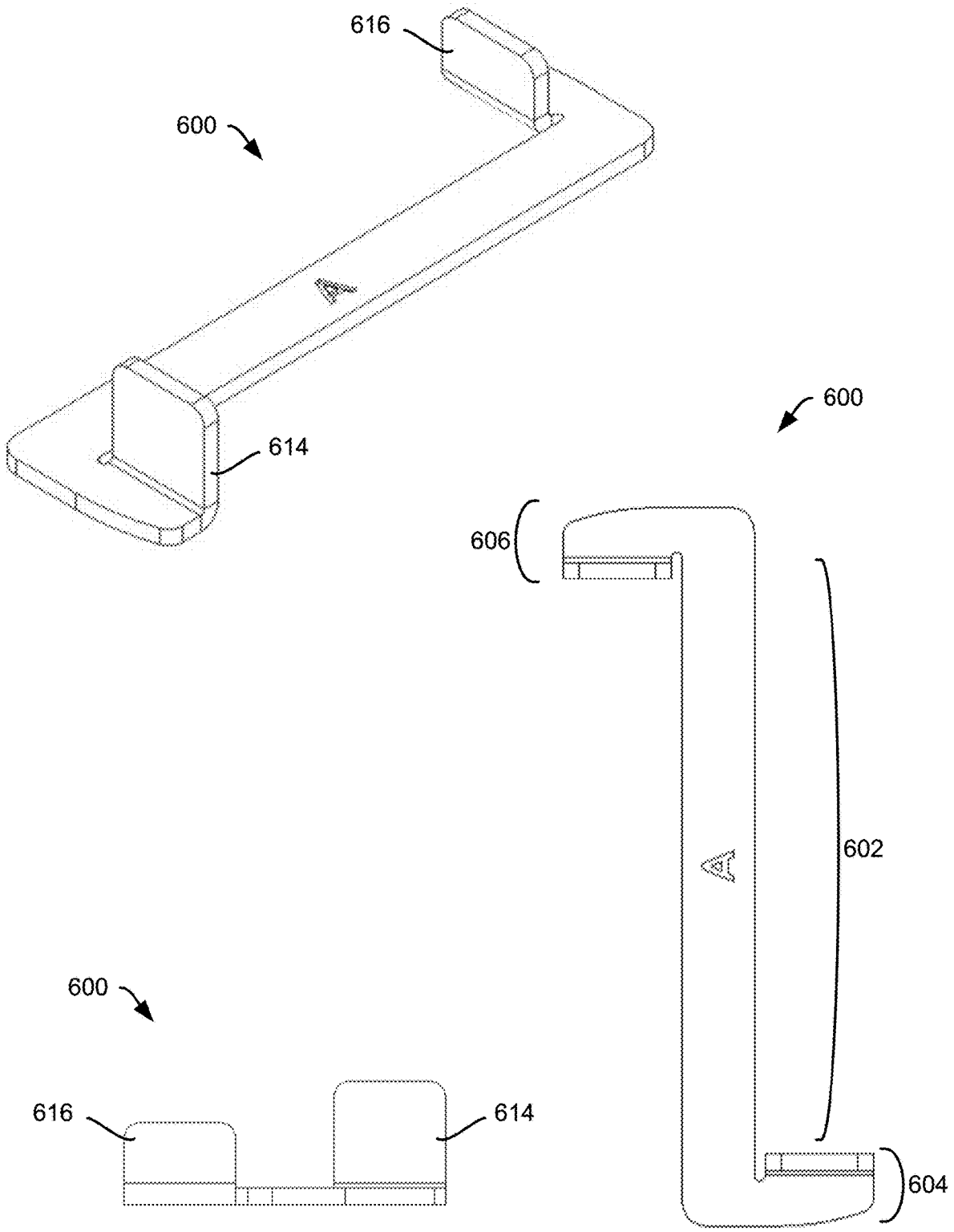
FIG. 6 is an illustrative representation of a shelf retaining clip in accordance with embodiments of the present invention.

FIG. 6 is an illustrative representation of shelf retaining clip 600 in accordance with embodiments of the present invention. In particular, FIG. 6 illustrates different views of shelf retaining clip 600 for clarity in understanding the embodiments disclosed herein. As illustrated, shelf retaining clip 600 includes planar body 602, leg 606 and leg 604 that each extend perpendicularly from the planar body along each end of the planar body. Each leg includes a corresponding shelf retaining clip tab 614 and 616 that each extend perpendicularly from the legs. Like shelf brackets 502A and 502B (see FIG. 5) above, shelf retaining clip embodiments include reverse duplicates. That is, for the shelf retaining clip shown, a reverse duplicate where the structures are the same but appear as mirror images (or structures) of one another are provided. As such, a shelf retaining clip and its reverse duplicate are placed in opposite corners of the system in embodiments. Furthermore, the shelf retaining clip tabs provide for the retention of shelves having different shelf thicknesses as the shelf retaining clip tabs differ in height. In some embodiments, one shelf retaining clip tab has a height in the range of approximately 0.125 to 0.500 inches and one shelf retaining clip tab has a height in the range of approximately 0.500 to 1.000 inches. In some embodiments, the shelf retaining clips have the same height. Placement and use of shelf retaining clips will be discussed in further detail below for FIG. 7.

Figure 7:
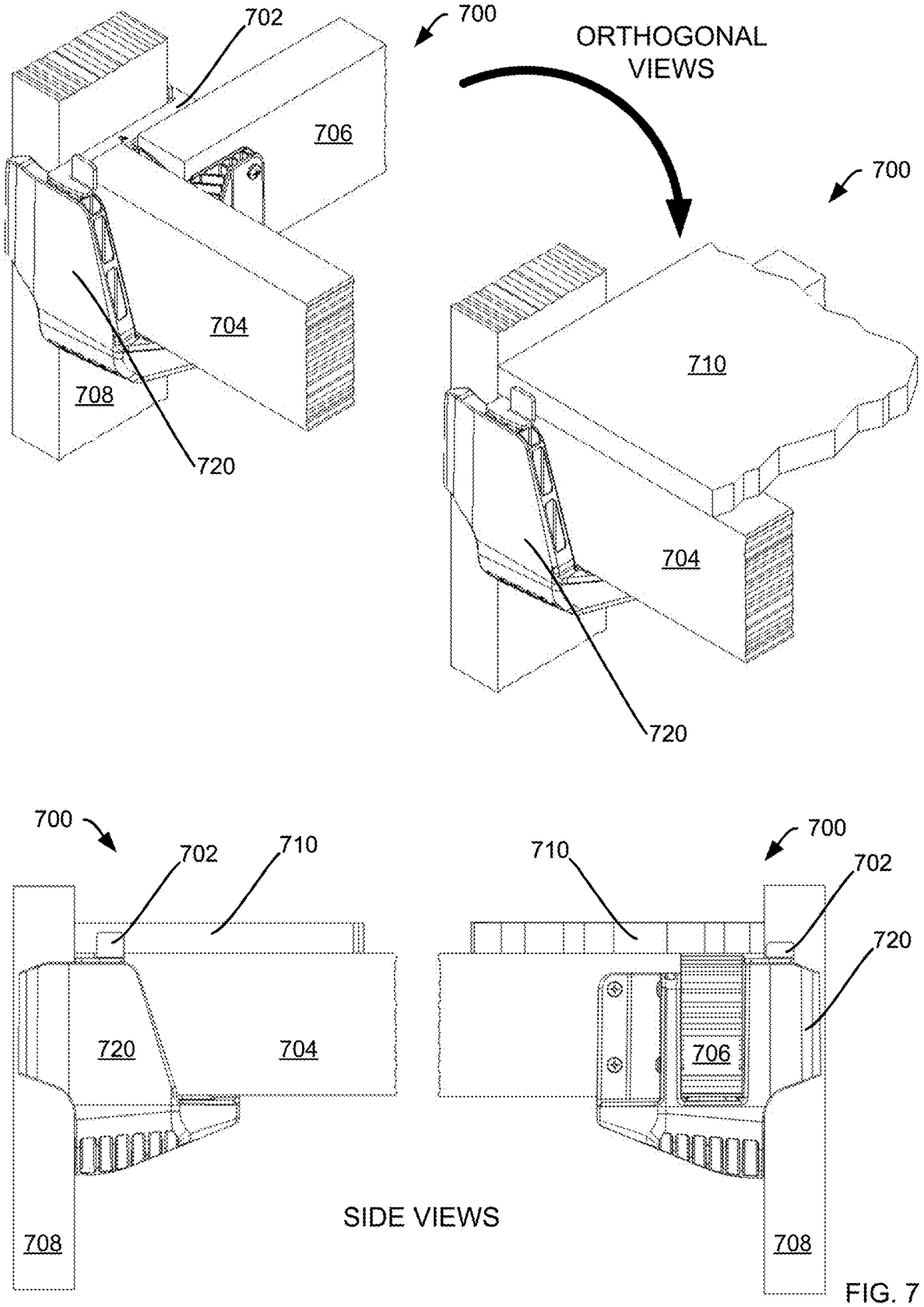
FIG. 7 is an illustrative representation of a shelving bracket system in use in accordance with embodiments of the present invention.

FIG. 7 is an illustrative representation of shelving bracket system 700 in use in accordance with embodiments of the present invention. In particular, FIG. 7 illustrates use of shelf retaining clip 702 in accordance with embodiments of the present invention. As illustrated, shelving bracket 720 is installed with vertical member 708 and horizontal members 704 and 706. In the embodiment illustrated, shelf retaining clip 702 is placed along a top edge of shelving bracket 720 along the clamping channel. The shelf retaining clip tabs engage vertical member 708 and shelf 710. In use, the shelf is supported by the horizontal members. Without a shelf retaining clip as disclosed herein, the shelf would not be secure without fastening directly to the horizontal members. When not fastened to horizontal members, the shelf may move in an undesirable fashion as items are placed on or removed from the shelving system. In embodiments, the shelf retaining clip is positioned in and captured by a channel formed by the shelving bracket top surface and the vertical and horizontal members on either side. In positioning the shelf over the shelf retaining clip, the weight of the shelf, along with any stored contents, prevents the shelf retaining clip from being removed from the channel. As illustrated, the shelf retaining clip is positioned along the shelving bracket such that the shelf retaining clip tabs engage the vertical member and the shelf. Thus, fore-and-aft movement of the shelf is restricted by the shelf retaining clip. In addition, side-to-side movement of the shelf is restricted by the vertical legs of the system positioned at each of the four corners of the system. Furthermore, because shelf retaining clip tabs are sized differently, embodiments may be effectively utilized with shelves of varying thickness by simply rotating the shelf retaining clip 180-degrees. Shelf retaining clip embodiments provide a mechanism by which shelves may be secured as well as provide a mechanism for easy removal by a user.

Figure 8:
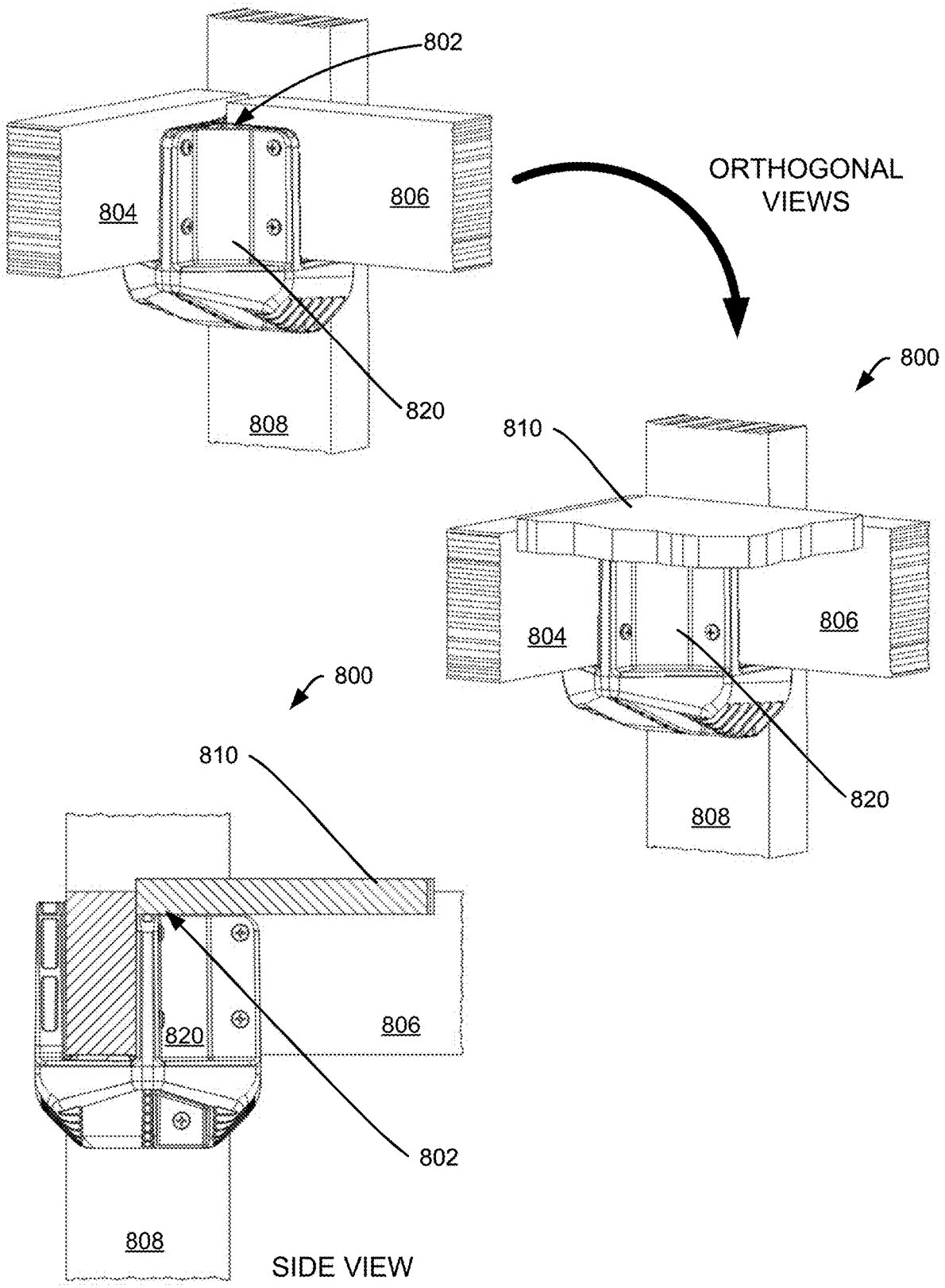
FIG. 8 is an illustrative representation of a shelving bracket system in use in accordance with embodiments of the present invention.

FIG. 8 is an illustrative representation of shelving bracket system 800 in use in accordance with embodiments of the present invention. In particular, FIG. 8 illustrates the use of cutaway portion 802 in accordance with embodiments of the present invention. As illustrated, shelving bracket 820 is installed with vertical member 808 and horizontal members 804 and 806. As noted above, in embodiments, cutaway portions provide a support platform for receiving a recessed shelf. As illustrated, recessed shelf 810 is recessed such that the shelf is retained by the horizontal members. In this embodiment, the recessed shelf is supported primarily by shelving bracket 820 along cutaway portion 802. Additional shelf support structures may be utilized along the horizontal members to accommodate heavier loads and thinner shelves.

Figure 9:
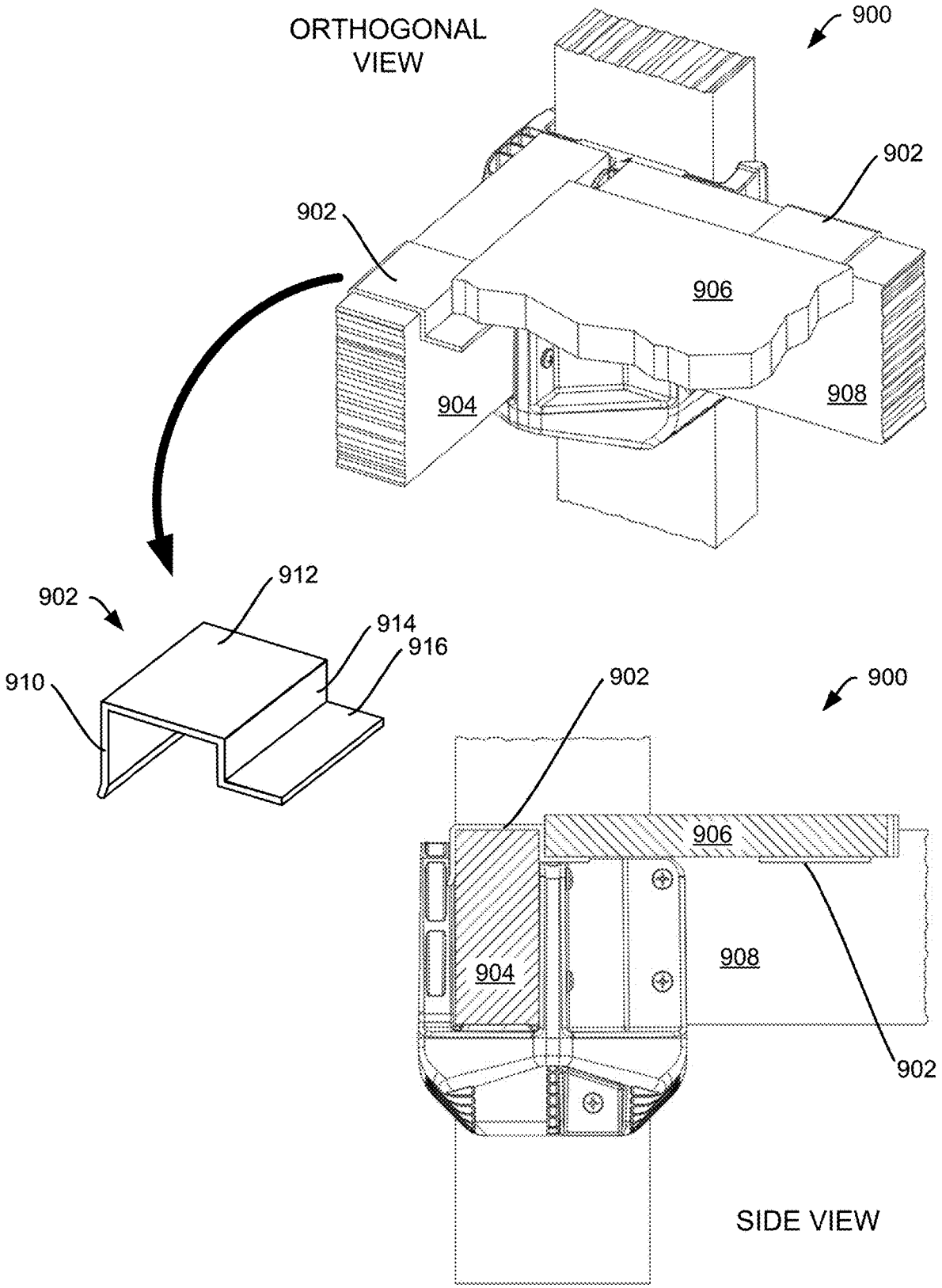
FIG. 9 is an illustrative representation of a shelving bracket system using shelf support structures in accordance with embodiments of the present invention.

FIG. 9 is an illustrative representation of shelving bracket system 900 using shelf support structure 902 in accordance with embodiments of the present invention. In particular, FIG. 9 illustrates different views of shelving bracket system 900 for clarity in understanding the embodiments disclosed herein. As noted above, additional shelf support structures may be utilized along the horizontal members to accommodate heavier loads and thinner shelves. As illustrated, shelf support 902 is positioned anywhere along a top surface of horizontal member 904 and/or a top surface of horizontal member 908 to support shelf 906. Further illustrated, is planar base 912 having outside leg 910 that extends downward from an outside edge of planar base 912. Further illustrated is inside leg 914 that extends downward from an inside edge of planar base 912; and support tab 916 that extends perpendicular from the inside leg 914. In some embodiments, shelf supports have a width of greater than approximately 0.75 inches. Shelf supports may be manufactured from any suitable material known in the art including, but not limited to a metal material, a semi-metallic material, and a polymeric material.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A shelving bracket comprising:

a clamping channel for capturing a vertical member, wherein the clamping channel is vertically adjustable along the vertical member, wherein the clamping channel comprises:

a base having a frontside surface and a backside surface;

a pair of clamping legs positioned along either side of the base extending from the backside surface, and wherein the clamping legs provide a clamping action against the vertical member such that a temporary holding position is maintained;

a load distribution wall positioned along the clamping channel;

a first cradle positioned along the clamping channel for capturing a first horizontal member; and a second cradle positioned along the clamping channel for capturing a second horizontal member, wherein the first horizontal member is retained perpendicular to the second horizontal member.

2. The shelving bracket of claim 1, wherein the pair of clamping legs are curved inwardly to clamping surfaces.

3. The shelving bracket of claim 2, wherein the clamping surfaces are spaced approximately 5% less than a width of the vertical member.

4. The shelving bracket of claim 1, wherein the load distribution wall comprises:

a top edge, wherein the top edge includes a cutaway portion for receiving a recessed shelf.

5. The shelving bracket of claim 4, wherein the first cradle comprises:

a first cradle base for supporting the first horizontal member, the first cradle base coupled with a first bottom portion of the clamping channel and a first bottom portion of the load distribution wall;

a first outside wall extending upward from the first cradle base and coupled with the clamping channel;

a first edge wall defined by a portion of the frontside surface of the clamping channel and extending upward from the first cradle base; and a first inside wall defined by a portion of the load distribution wall proximate with the cutaway portion and extending upward from the first cradle base.

6. The shelving bracket of claim 5, wherein the first cradle base further comprises:

a first raised feature positioned along a surface of the first cradle base for providing relief clearance for the first horizontal member.

7. The shelving bracket of claim 5, further comprising:

a first plurality of reliefs are formed along a first corner of the first edge wall and the first outside wall and along a second corner of the first edge wall and the first inside wall.

8. The shelving bracket of claim 4, wherein the second cradle comprises:

a second cradle base for supporting the second horizontal member, the second cradle base coupled with a second bottom portion of the clamping channel and a second bottom portion of the load distribution wall;

a second outside wall defined by a portion of the frontside surface of the clamping channel and extending upward from the second cradle base;

a second edge wall defined by a portion of the load distribution wall proximate with the cutaway portion and extending upward from the second cradle base; and a second inside wall extending upward from the second cradle base and coupled along a portion of the load distribution wall proximate with the cutaway portion.

9. The shelving bracket of claim 8, wherein the second cradle base further comprises:

a second raised feature positioned along a surface of the second cradle base for providing relief clearance for the second horizontal member.

10. The shelving bracket of claim 8, further comprising:

a second plurality of reliefs are formed along a third corner of the second edge wall and the second outside wall and along a fourth corner of the second edge wall and the second inside wall.

11. The shelving bracket of claim 1, wherein the vertical member, the first horizontal member, and the second horizontal member comprise dimensional lumber.

12. A shelving system comprising:

a plurality of shelving brackets each comprising:

a clamping channel for capturing a vertical member, wherein the clamping channel is vertically adjustable along the vertical member;

a load distribution wall positioned along the clamping channel;

a first cradle positioned along the clamping channel for capturing a first horizontal member; and a second cradle positioned along the clamping channel for capturing a second horizontal member, wherein the first horizontal member is retained perpendicular to the second horizontal member, wherein the plurality of shelving brackets are paired as mirror structures of one another;

a plurality of shelf retaining clips for retaining a shelf wherein the plurality of shelf retaining clips are paired as mirror structures of one another; and a plurality of shelf supports for supporting the shelf.

13. The shelving system of claim 12, wherein the vertical member, the first horizontal member, and the second horizontal member comprise dimensional lumber.

14. The shelving system of claim 12, wherein the plurality of shelf retaining clips each comprise:

a planar body;

a first leg extending perpendicularly from the planar body along a first end of the planar body;

a first shelf retaining clip tab extending perpendicularly from the first leg;

a second leg extending perpendicularly from the planar body along a second end of the planar body;

a second shelf retaining clip tab extending perpendicularly from the second leg.

15. The shelving system of claim 12, wherein the plurality of shelf supports each comprise:

a planar base;

an outside leg that extends downward from an outside edge of the planar base;

an inside leg that extends downward from an inside edge of the planar base; and a support tab that extends perpendicularly from the inside leg.

* * * * *